United States Patent [19]

Ketcham et al.

[11] Patent Number: 4,770,673

[45] Date of Patent: Sep. 13, 1988

[54] CERAMIC CUTTING TOOL INSERTS

[75] Inventors: Thomas D. Ketcham, Big Flats; David S. Weiss, Corning, both of N.Y.

[73] Assignee: Corning Glass Works, Corning, N.Y.

[21] Appl. No.: 106,433

[22] Filed: Oct. 9, 1987

[51] Int. Cl.[4] ..... B24D 3/02

[52] U.S. Cl. ..... 51/309; 51/293; 51/307; 51/308; 501/103; 501/105

[58] Field of Search ..... 51/293, 307, 308, 309; 501/103, 105

[56] References Cited

U.S. PATENT DOCUMENTS

| | | | |
|---|---|---|---|
| 4,063,908 | 12/1977 | Ogawa et al. | 51/309 |
| 4,325,710 | 4/1982 | Tanaka et al. | 51/309 |
| 4,343,909 | 8/1982 | Adams et al. | 51/309 |
| 4,366,254 | 12/1982 | Rich et al. | 51/309 |
| 4,425,141 | 1/1984 | Buljan et al. | 51/309 |
| 4,518,398 | 5/1985 | Tanaka et al. | 51/309 |
| 4,526,875 | 7/1985 | Yamamoto et al. | 51/309 |
| 4,533,647 | 8/1985 | Tien | 501/105 |
| 4,543,345 | 9/1985 | Wei | 501/95 |
| 4,598,053 | 7/1986 | Yamakawa et al. | 51/309 |
| 4,701,384 | 10/1987 | Sarin et al. | 51/309 |

*Primary Examiner*—Paul Lieberman
*Assistant Examiner*—Willie J. Thompson
*Attorney, Agent, or Firm*—Clinton S. Janes, Jr.

[57] ABSTRACT

This invention is concerned with the production of a hard, tough, thermally conductive ceramic cutting tool insert consisting essentially of a zirconia alloy in a hard refractory ceramic insert. The ceramic cutting tool insert exhibits performance conducive to use in turning operations and/or milling operations.

17 Claims, 1 Drawing Sheet

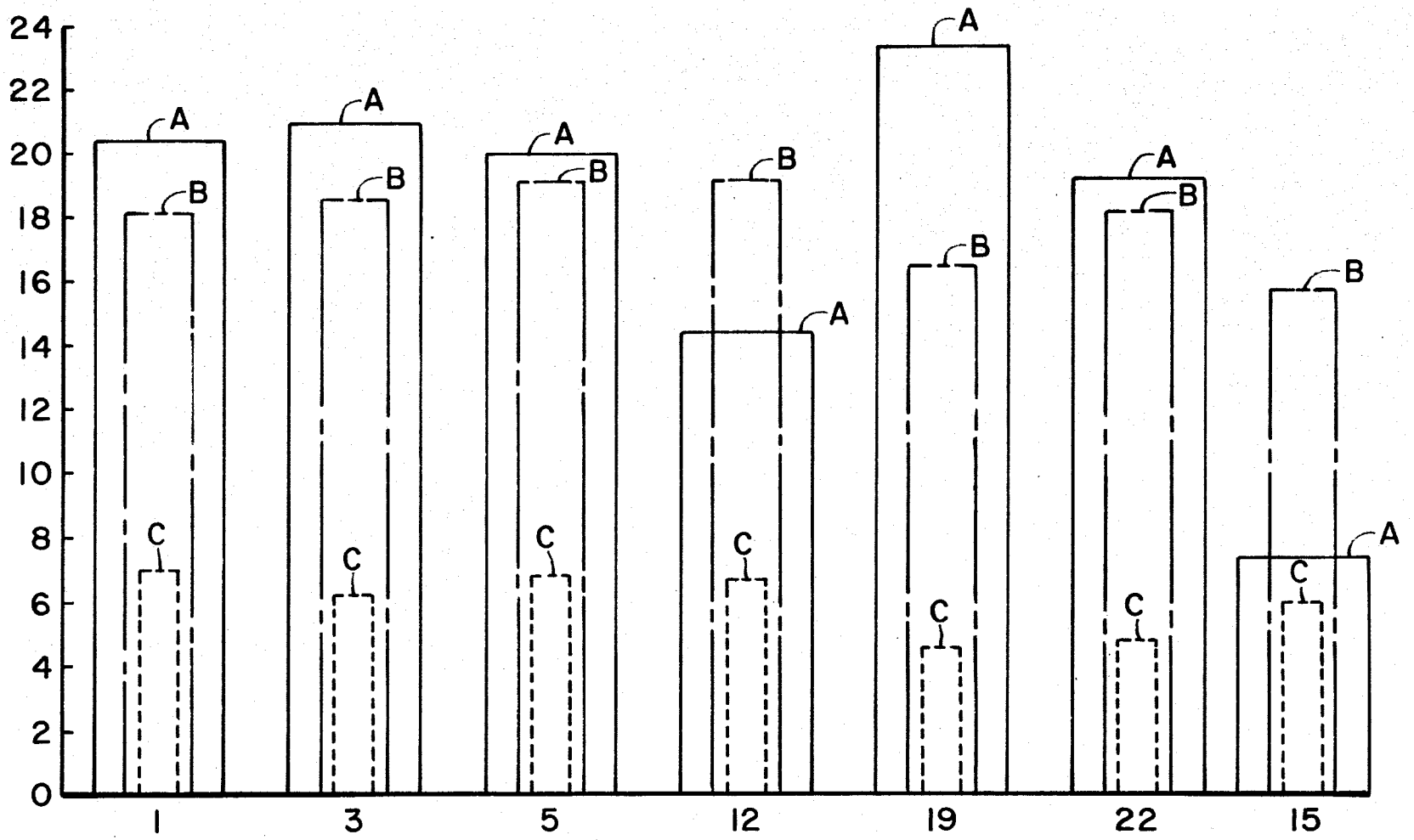
24
22
20
18
16
14
12
10
8
6
4
2
0
A
B
C
1
3
5
12
19
22
15

CERAMIC CUTTING TOOL INSERTS

BACKGROUND OF THE INVENTION

The machining and shaping of metal articles by means of milling and turning operations have been a part of modern society since the dawn of the Industrial Revolution. As would be expected, tools or at least the tips of tools for forming metal articles were initially fashioned from metals. As the feeding speeds and the rotating speeds in milling and turning operations increased, however, such that the tips of the tools encountered higher and higher temperatures, it soon became evident that the tips reacted chemically with the metal workpiece and quickly wore away. Inasmuch as those actions were undesirable, numerous efforts were undertaken to harden the tool tip, while decreasing the chemical reactivity thereof with respect to the metal workpiece.

As a result, the prior art is replete with materials for cutting tool tips (or "inserts" as defined in the cutting tool art) as substitutes for metals. In general, the prior art has disclosed the use of hard refractory ceramics as components for cutting tool inserts. To illustrate:

U.S. Pat. No. 4,063,908 describes the incorporation of $TiO_2$ and TiC into an $Al_2O_3$ sintered ceramic body. U.S. Pat. No. 4,204,873 reports the inclusion of WC and TiN in a sintered ceramic body containing $Al_2O_3$. In like manner U.S. Pat. No. 4,366,254 records the addition of $ZrO_2$, TiN or TiC, and rare earth metal carbides to a base $Al_2O_3$ ceramic body.

In general, cutting tool inserts have been expressly designed for either milling or turning operations. That is, inserts designed for one operation have not customarily been used in the other because the wear characteristics of the two operations are quite different. Thus, cutting tool inserts designed for turning will commonly fail relatively rapidly when employed in a milling operation, with a like situation obtaining when tool inserts designed for milling are used in turning. More recently, cutting tool inserts are being produced which perform both turning and milling operations with limited success.

A variety of physical properties must be present for a ceramic cutting tool insert to perform satisfactorily. Among these properties are hardness, thermal conductivity, strength, and toughness (all as a function of temperature). Undesirable phase transformations of phases within the insert occurring with changes of temperature must be avoided and, as mentioned above, chemical reactivity with the workpiece should be minimized. Whereas an individual material may excel in several properties, a deficiency in another area may make the material useless as a cutting tool insert. An example of such a deficiency is zirconia, where the strength and toughness of the material are excellent but the thermal conductivity is low and the hardness is low. The low thermal conductivity property results in the tip of the insert during use becoming so hot that it can be made to flow plastically.

A standardized test has been developed for each of those two types of metal removal operations; viz., the turning test and the interrupted cut or milling test. The two tests can be broadly characterized in terms of the action each encounters. Hence, turning is largely a measure of an insert material's resistance to abrasion and chemical wear. The interrupted cut test measures the ability of an insert material to resist thermal and mechanical shock.

In the turning test, a bar of metal (the "workpiece") is mounted on a lathe and turned at predetermined speeds against the insert. The insert is mounted in a tool holder which is moved along the length of the workpiece. The amount of metal removed from the workpiece per unit time is a function of three factors: first, the speed at which the spindle that turns the workpiece rotates in terms of revolutions per minute (RPM); second, the rate at which the insert is moved from one end to the other parallel to its axis into the length of the workpiece by the tool holder, that rate being measured in terms of inches per minute per revolution (IPR) of the workpiece; and, third, the distance which the insert cuts into the workpiece, that distance being measured as the depth of cut (DOC). The first two operations combined give the standard measure for the rate of metal removal which is customarily defined in terms of surface feet per minute (SFPM). In the standard procedure for conducting the test, IPR is held at 0.010", DOC is maintained at 0.075", and the RPM is varied depending upon the desired rate of metal removal.

The interrupted cut test uses a turret lathe with a single insert mounted in the cutting head. As such, the insert essentially chops away at a workpiece as it is moved laterally across the rotating cutting head. The interrupted cut test is dynamic since the feed rate increases as the test progresses. In the test matrix of the present invention, the first twenty cuts are made with a feed rate of 0.0025 IPR which is increased after each successive 5 passes (or cuts) by 0.0025 IPR increments, so that on the twentieth pass the feed rate is 0.010 IPR. Subsequent cuts, 21–60, have an increased rate of 0.0050 IPR for each 5 passes, such that pass 21 has a feed rate of 0.015 IPR and cut 60 has a feed rate of 0.050 IPR. The feed rate of 0.050 IPR is the upper limit since it represents the maximum capacity of the test equipment. This test provides information regarding the resistance to thermal and mechanical shock of a material and is terminated at failure of the insert.

Good thermal and mechanical shock resistance is required for satisfactory performance of an insert in the milling operation. Additionally, such thermal and mechanical properties are required in turning operations. Under cutting conditions in turning operations, such as a heavy feed rate, deep depth of cut, or when a coolant is in use, an insert must have the ability to resist the thermal and mechanical force inherent to such conditions. The same durability must exist when the insert is subjected to an inhomogeneous workpiece material; for instance, where hard inclusions are encountered in the workpiece or when scaly surfaces are being turned down. Therefore, good performance in the interrupted cut screen test indicates that an insert material may perform well under conditions found in many turning operations.

The above tests can be designed to simulate accelerated wear tests by using increased cutting speeds. For example, the turning test employs speeds of about 2000–3000 SFPM, those rates being substantially higher than the 800–1000 SFPM typically used in industry. Thus, in general, the higher the cutting speed, the higher the temperature at the insert/workpiece interface. The elevated temperature (perhaps 1300° C. or higher at 2500–3000 SFPM) at such high cutting speeds causes greater plastic deformation of the workpiece, thereby resulting in lower abrasive wear and mechanical shock due to cutting as the hot metal is removed. Higher temperatures, however, promote increased chemical reaction rates and, therefore, enhance temperature-related wear mechanisms; e.g., adhesive wear.

Whereas research has been extensive to develop improved inserts for cutting tools from ceramic compositions, there has remained the need for inserts designed for metal milling and turning operations which exhibit durability and reliability significantly better than products currently available.

Therefore, the primary objective of the present invention was to develop cutting tool inserts demonstrating exceptional toughness, wear resistance, impact resistance, thermal conductivity, and thermal shock resistance rendering them especially suitable for use in milling and turning operations.

SUMMARY OF THE INVENTION

U.S. application Ser. No. 926,655, filed Nov. 4, 1986 in the name of Thomas D. Ketcham under the title HIGH TOUGHNESS CERAMIC ALLOYS, commonly assigned herewith, reports the production of ceramic alloys exhibiting exceptionally high toughness values, as measured in terms of fracture toughness ($K_{IC}$) values. The alloys disclosed therein consist essentially, expressed in terms of mole percent on the oxide basis, of about 0.5–8% of a toughening agent with zirconia comprising the remainder. Because of its relationship to the present invention, the disclosure of that application as filed is incorporated by reference herein in its entirety. However, a brief summary of that disclosure as it specifically pertains to the instant invention is provided here.

Thus, as is explained therein, the toughening agent was selected from the group consisting of $YNbO_4$, $YTaO_4$, $MNbO_4$, $MTaO_4$, and mixtures thereof, wherein M consists of a cation which replaces a Y cation on a mole basis selected from the group consisting of $Mg^{+2}$, $Ca^{+2}$, $Sc^{+3}$, and a rare earth metal ion selected from the group consisting of $La^{+3}$, $Ce^{+4}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, and mixtures thereof. That application also describes the formation of various composite bodies wherein the alloy constitutes one element. For example, refractory ceramic fibers and/or whiskers such as alumina, mullite, sialon, silicon carbide, silicon nitride, AlN, BN, $B_4C$, $ZrO_2$, zircon, silicon oxycarbide, and spinel can be entrained within the alloy body. The alloy can be blended into a matrix of a hard refractory ceramic such as alumina, $Al_2O_3$-$Cr_2O_3$ solid solution, sialon, silicon carbide, silicon nitride, titanium carbide, titanium diboride, and zirconium carbide. Finally, a composite can be prepared consisting of a mixture of alloy, refractory ceramic fibers and/or whiskers, and hard refractory ceramic.

The present invention is based upon the discovery that, by incorporating a narrowly-defined amount of a ceramic alloy of the type described in the above application into a matrix consisting of a hard refractory ceramic of the type described in the above application, which may optionally have refractory ceramic fibers and/or whiskers, also of the type described in the above application, entrained therewithin, a material can be prepared which exhibits physical and chemical characteristics rendering them exceptionally operable for use as cutting tool inserts. Thus, the hard, tough, thermally conductive ceramic cutting tool inserts of the present invention consist essentially, expressed in terms of weight percent, of 55–80% hard refractory ceramic and 20–45% zirconia alloy, said zirconia alloy consisting essentially, expressed in terms of mole percent on the oxide basis, of 1–4% of a toughening agent selected from the group consisting of $YNbO_4$, $YTaO_4$, $MNbO_4$, $MTaO_4$, and mixtures thereof, wherein M consists of a cation which replaces a Y cation on a mole basis selected from the group consisting of $Mg^{+2}$, $Ca^{+2}$, $Sc^{+3}$, and a rare earth metal ion selected from the group consisting of $La^{+3}$, $Ce^{+4}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, and mixtures thereof, and the remainder zirconia. The most preferred alloys employ $YNbO_4$ and/or $YTaO_4$ as the toughening agent. The zirconia may be partially stabilized through the presence of known stabilizers such as CaO, $CeO_2$, MgO, $Nd_2O_3$, and $Y_2O_3$. In general, the concentration of such stabilizers will range about 0.5–6 mole percent, with $Y_2O_3$ being the most preferred in amounts between about 0.5–2 mole percent. Accordingly, as employed herein, the term zirconia includes $ZrO_2$ partially stabilized through the presence of a minor amount of a known stabilizer. Also, the term zirconia is not to be limited to any particular crystal phase or lattice configuration, but encompasses each of the phases and lattice configurations within the zirconia potential. In general, the level of refractory ceramic fibers and/or whiskers optionally entrained within the body of the insert will not exceed about 35% by volume.

The microstructure of the final material is of importance in addition to the composition of the cutting tool insert. Thus, the alloy must be distributed homogeneously within the hard refractory ceramic matrix and agglomerates thereof should be avoided. Hence, it has been observed that the presence of alloy agglomerates of about 50 microns or greater in size causes the insert to become weak; microcracks propagate to and from those inhomogeneities throughout the matrix.

Ser. No. 926,655, supra, discloses two general methods for forming finely-divided, sinterable powders of the ceramic alloys. The first method comprises a coprecipitation process, whereas the second method involves utilizing a commercial, $Y_2O_3$-containing partially stabilized $ZrO_2$ as the starting material which is modified through various additions. Both of those methods are appropriate for providing alloy powders suitable for use in the production of the present inventive inserts. The full description of the coprecipitation and addition methods recited in Ser. No. 926,655 as filed is incorporated here by reference. A brief description of one embodiment of each method is provided utilizing $YNbO_4$ as the toughening agent.

In the coprecipitation procedure, $NbCl_5$ was dissolved into aqueous HCl to form a solution filterable through a 0.3–1 micron filter. Concentrated aqueous solution of zirconyl nitrate and $Y(NO_3)_3.6H_2O$ was added to the $NbCl_5$/HCl solution. Aqueous $NH_4OH$ was added, a large excess being used to obtain a high supersaturation, and the coprecipitation was carried out quickly to avoid segregation of the cations. The resulting precipitant gel was washed several times in a centrifuge with aqueous $NH_4OH$ at a pH > 10, water trapped in the gel being removed by freeze drying. The dried material was calcined for two hours at about 1000° C. and an isopropyl alcohol slurry of the calcine vibramilled for three days using $ZrO_2$ beads. The slurry was screened to extract the beads and then evaporated off. The resulting powder had a particle size less than 1 micron and, typically, less than 0.3 micron.

The above method quite obviously reflects laboratory practice only; various modifications in the individual steps become immediately apparent to the skilled worker in the art.

In the addition procedure, powdered $Nb_2O_5$ was blended into a slurry composed of methanol and powdered commercial, partially stabilized $ZrO_2$ ($ZrO_2$-3 mole % $Y_2O_3$) and vibramilled for 2.5 days employing $ZrO_2$ beads. The slurry was screened to remove the beads, the methanol evaporated off, and the resultant powder calcined for two hours at 800° C. The resulting particles had diameters of less than 5 microns and, preferably, less than 2 microns.

In like manner to the coprecipitation method, the above description represents laboratory procedure only; various modifications in the individual steps become immediately apparent to the worker in the art.

The preferred process for forming the inventive inserts comprises three general steps:

(a) powders of the alloy and the hard refractory ceramic are mixed in desired proportions, care being taken to insure that no agglomerates greater than 50 microns in diameter and, preferably, no greater than 10 microns are produced (binders and lubricants may optionally be included and refractory ceramic fibers and/or whiskers may be entrained, if desired);

(b) the resultant mixture is shaped into a desired configuration; and (c) that shape is sintered into an integral body by firing at temperatures between about 1100°-1700° C.

Shaping of the mixture into a desired form will commonly be undertaken through a pressing operation, although the small inserts can be produced through extrusion. Hence, the mixture may be uniaxially dry pressed or isostatically cold pressed, or the mixture may be uniaxially or isostatically hot pressed. The sintering step may be conducted concurrently with or prior to hot pressing. For example, the mixture may be sintered at 1100°-1700° C. followed by hot isostatic pressing in the same temperature range. Where binders/dispersants are employed in shaping the bodies, they must be removed prior to sintering by heating the body to an elevated temperature below the sintering temperature, e.g., 300°-800° C., for a period of time sufficient to volatilize/burn off those materials. The sintering may be carried out in air (an oxidizing atmosphere) or in a non-oxidizing atmosphere with apparent equivalent results.

Cutting tool inserts can be prepared by simply mixing the base ingredients together in the proper proportions, shaping that mixture into a desired configuration, and then sintering that shape at 1100°-1700° C. Hence, such products can be produced by:

(a) forming a mixture of powders consisting essentially of a hard refractory ceramic, zirconia, a toughening agent selected from the group consisting of $YNbO_4$, $YTaO_4$, $MNbO_4$, $MTaO_4$, and mixtures thereof, wherein M consists of a cation which replaces a Y cation on a mole basis selected from the group consisting of $Mg^{+2}$, $Ca^{+2}$, $Sc^{+3}$, and a rare earth metal ion selected from the group consisting of $La^{+3}$, $Ce^{+4}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, and mixtures thereof, or components which, when reacted together, will form said toughening agent, and, if desired, a stabilizing agent for zirconia, said powders being present in sufficient amounts and in the proper proportions to produce, upon sintering, a body consisting essentially, expressed in terms of percent by weight, of 20-45% zirconia alloy and 55-80% hard refractory ceramic, said zirconia alloy consisting essentially, expressed in terms of mole percent on the oxide basis, of 1-4% toughening agent and the remainder zirconia;

(b) shaping said mixture into a desired configuration for a cutting tool insert; and (c) sintering said shaped mixture at temperatures between about 1100° C.-1700° C. to form a hard, tough, thermally conductive body.

The above method has the practical advantage of not requiring the initial preparation of the $ZrO_2$ alloy. However, the properties exhibited by inserts prepared in this manner appear to be somewhat less consistent than where the alloy is first prepared and then mixed with the hard refractory ceramic. Hence, whereas the alloy will be formed from the mixture of powders of the hard refractory ceramic and the components making up the alloy, it is difficult to insure that an appropriate concentration of alloy will be available throughout the body to yield uniform hardness, toughness, and thermal conductivity.

To illustrate that practice, a zirconia alloy/alumina body was prepared in accordance with the following steps:

(a) suitable powder proportions of zirconia, $Nb_2O_5$, $Y_2O_3$, and alumina were mixed together in a plastic jar by shaking with $ZrO_2$ mixing balls;

(b) the powder mixture was blended into distilled water to form a slurry (other liquids evidencing no reaction with the powders, e.g., methanol, isopropanol, and methyl ethyl ketone, would self-evidently be operable);

(c) the slurry was vibramilled for three days;

(d) the slurry was spray dried (other methods of drying, e.g., simple oven drying, would also self-evidently be operable); and thereafter (e) the dried material was uniaxially hot pressed in a graphite die for one hour at 1450° C. at a pressure of 6000 psi.

It will be appreciated that where fibers and/or whiskers are desired in the product, they can be entrained in any step up to the sintering. Hence, it is only necessary that they be entrained in the shape that is to be sintered.

Experience has indicated that, from a practical point of view, alumina comprises the preferred hard refractory ceramic matrix for the alloy in forming cutting tool inserts. The addition of up to 5 mole percent $Cr_2O_3$ to the base combination of alloy and alumina appears to improve the wear resistance performance of the inserts. At additions above about 5%, however, the thermal conductivity of the body is reduced to such an extent that the insert becomes so hot during use that plastic deformation thereof can take place. The mechanism underlying the effect which $Cr_2O_3$ exerts in reducing the thermal conductivity of sintered $Al_2O_3$-$Cr_2O_3$ bodies is illustrated in U.S. Pat. No. 4,533,647. Cutting tool inserts prepared from alloytoughened titanium diboride and mixtures of alumina and titanium diboride also perform well, but the cost of titanium diboride is greater than alumina. Coating the insert with titanium carbide, titanium nitride, zirconium carbide, and other coatings known to those skilled in the art, increases the abrasive resistance of the product.

SiC fibers and whiskers comprise the preferred refractory ceramic fibers and whiskers.

DESCRIPTION OF PREFERRED EMBODIMENTS

Table I reports a number of compositions, expressed in terms of mole percent alloy and mole percent matrix, illustrating the parameters of the instant invention. The toughening agent constituents of the alloy are stated individually in terms of mole percent on the oxide basis, as are additional yttria and $Cr_2O_3$, where present. Zirconia composes the remainder of the alloy.

The alloys were prepared utilizing the addition procedure described above. Thereafter, the alloy powder was mixed with powder of the matrix material without the inclusion of binders and lubricants, and that mixture uniaxially hot pressed in a graphite die for one hour at 1450° C. at a pressure of 6000 psi.

TABLE I

| Example | Alloy in mole % | Matrix in mole % |
|---|---|---|
| 1 | 18.2% (2% $YNbO_4$) | 81.8% $Al_2O_3$ |
| 2 | 18.2% (3.5% $YNbO_4$) | 81.8% $Al_2O_3$ |
| 3 | 18.2% (4.7% $YNbO_4$) | 81.8% $Al_2O_3$ |
| 4 | 24.0% (2% $YNbO_4$) | 76.0% $Al_2O_3$ |
| 5 | 24.0% (2.1% $YNbO_4$-1% $Y_2O_3$) | 76.0% $Al_2O_3$ |
| 6 | 24.0% (4.2% $YNbO_4$) | 76.0% $Al_2O_3$ |
| 7 | 29.6% (2% $YNbO_4$) | 70.4% $Al_2O_3$ |
| 8 | 35.1% (1% $YNbO_4$) | 64.9% $Al_2O_3$ |
| 9 | 35.1% (2% $YNbO_4$) | 64.9% $Al_2O_3$ |
| 10 | 35.1% (3.1% $YNbO_4$) | 64.9% $Al_2O_3$ |
| 11 | 19.4% (2.1% $YTaO_4$) | 80.6% $Al_2O_3$ |
| 12 | 18.2% (2% $YNbO_4$) | 81.8% ($Al_2O_3$-3% $Cr_2O_3$) |
| 13 | 20.3% (3.1% $YNbO_4$-1% $Y_2O_3$) | 79.7% $TiB_2$ |
| 14 | 24.0% (2% $NdNbO_4$) | 76.0% $Al_2O_3$ |
| 15 | 18.2% (2% $YNbO_4$) | 81.8% ($Al_2O_3$-30% $Cr_2O_3$) |
| 16 | 6.1% (2% $YNbO_4$) | 93.9% $Al_2O_3$ |
| 17 | 12.3% (1% $YNbO_4$) | 87.7% $Al_2O_3$ |
| 18 | 12.3% (2% $YNbO_4$) | 87.7% $Al_2O_3$ |
| 19 | 12.3% (4.2% $YNbO_4$) | 87.7% $Al_2O_3$ |
| 20 | 18.2% (8.7% $YNbO_4$) | 81.8% $Al_2O_3$ |
| 21 | 18.2% (11.1% $YNbO_4$) | 81.8% $Al_2O_3$ |
| 22 | 24.0% (1% $YNbO_4$) | 76.0% $Al_2O_3$ |
| 23 | 45.7% (2% $YNbO_4$) | 54.3% $Al_2O_3$ |

We have observed a strong correlation existing between the hardness, toughness, and thermal conductivity exhibited by a material and its utility in service as a cutting tool insert. Hence, we have found that materials demonstrating a fracture toughness ($K_{IC}$) of at least 6 MPa$\sqrt{m}$ and a Vickers hardness greater than about 15.0 GPa perform very satisfactorily as cutting tool inserts, if thermal conductivity properties are within acceptable values. Excessive hardness without commensurate toughness leads to chipping of the insert. Therefore, indentation toughness and hardness measurements have been employed as rapid screening tests for proposed compositions. Samples are prepared by grinding and polishing the sintered bodies to a mirror finish. Thereafter, toughness and hardness were measured by the indentation method of Anstis et al., as reported in the *Journal of the American Ceramic Society,* pages 533–538, September 1981. Using the value $\hat{x}$ for AD999 alumina gives the equation, $$K_{IC}=0.0175P^{\frac{1}{2}}E^{\frac{1}{2}}dC^{-3/2}$$

Hardness is the usual Vickers hardness, as defined in $H=1.854\ P/d^2$, where P in both equations is the load, C is the crack length, d in both equations is the length of the indent diagonal, and E is the elastic modulus assumed to be 380 GPa for alumina, 200 GPa for zirconia yttrium niobate alloy, and 450 GPa for titanium diboride. The load used was 10 Kg.

Table II records values of Vickers hardness, expressed in terms of GPa, and fracture toughness ($K_{IC}$), expressed in terms of MPa$\sqrt{m}$, as measured on the Examples of Table I.

TABLE II

| Example | Hardness | Toughness |
|---|---|---|
| 1 | 18.2 | 7.1 |
| 2 | 19.1 | 6.1 |
| 3 | 18.6 | 6.3 |
| 4 | 17.3 | 6.0 |
| 5 | 19.1 | 6.8 |
| 6 | 18.2 | 6.1 |
| 7 | 16.5 | 6.2 |
| 8 | 16.1 | 6.8 |
| 9 | 16.1 | 6.2 |
| 10 | 15.7 | 6.2 |
| 11 | 19.1 | 6.15 |
| 12 | 19.1 | 6.8 |
| 13 | 17.3 | 6.0 |
| 14 | 15.0 | 6.7 |
| 15 | 15.7 | 6.2 |
| 16 | 21.2 | 3.7 |
| 17 | 20.1 | 5.1 |
| 18 | 18.6 | 4.3 |
| 19 | 16.5 | 4.7 |
| 20 | 18.2 | 4.4 |
| 21 | 19.1 | 4.85 |
| 22 | 18.2 | 5.0 |
| 23 | 14.4 | Microcracked |

As can be observed, Examples 16–23 exhibit toughness and/or hardness values below those found suitable for cutting tool inserts.

Table V shows thermal conductivity values calculated from thermal diffusivity data by the following equation:

$$\text{Thermal Conductivity} = \text{Density} \times \text{Specific Heat} \times \text{Thermal Diffusivity}$$

TABLE V

| Example | Thermal Conductivity $Wm^{-1}{}^{\circ}K.^{-1}$ |
|---|---|
| 1 | 20.42 |
| 3 | 20.87 |
| 5 | 19.94 |
| 12 | 14.35 |
| 15 | 7.38 |
| 19 | 23.26 |
| 22 | 19.2 |

As stated above, for cutting tool insert material to provide satisfactory performance, a certain minimum value each of hardness, toughness, and thermal conductivity properties is critical. The bar graphs provided in the appended drawing illustrate how these three properties interrelate. The graphic designated A relates to thermal conductivity, that designated B relates to hardness, and that designated C relates to toughness. Examples 1, 3, and 5 were found to perform in a superior manner as cutting tool inserts. All three of these examples had toughness values greater than 6.0 MPa$\sqrt{m}$, hardness values greater than 15.0 GPa, and thermal conductivity values greater than 14 $Wm^{-1}\ {}^{\circ}K.^{-1}$. In comparison, examples 19 and 22 were found to be unacceptable cutting tool inserts. Example 19, while exhibiting an acceptable thermal conductivity and hardness values, suffers from a low, 4.7 MPa$\sqrt{m}$, toughness value. Example 22 has acceptable thermal conductivity and hardness properties but has a toughness of only 5.0 MPa$\sqrt{m}$. Example 15 shows acceptable toughness and hardness values; however, the thermal conductivity has an unacceptably low 7.38 W/M $Wm^{-1}°K.^{-1}$ value because of the excessive $Cr_2O_3$ content. Example 12 exhibits a toughness value of 6.15 MPa$\sqrt{m}$, a hardness value of 19.1 GPa, and a thermal conductivity value of 14.35 $Wm^{-1}°K.^{-1}$ and represents an outer limit of acceptable cutting tool performance due to its thermal conductivity. Although Examples 8 and 22 have similar compositions, Example 22 was found not to meet the toughness criterion. It is posited that the effective concentration of the alloy in the matrix is too low to achieve the desired properties for a satisfactory cutting tool insert. As can be seen from the above data, cutting tool inserts made from the inventive alloy must, once incorporated into a suitable matrix, have certain minimum values. If the properties of the material do not exhibit those minimum values, the material will not perform well as a cutting tool insert.

Table VI reports cutting tool insert test results for examples 1, 3, 5, 19 and 22.

TABLE VI

| Example | Time to Failure Turning Test | Number of Cuts Cutting Test (Shock Test) |
|---|---|---|
| 1 | 2556 | 36 |
| 3 | 2018 | 27 |
| 5 | 2116 | 34 |
| 19 | 924 | 22 |
| 22 | 1506 | 21 |
| Std | 1569 | 8 |

The standard cutting tool insert, a commercial material made of an alloy containing alumina and titanium carbide, which heretofore exhibited values which were used as the benchmark of an acceptable insert, is designated as Std in Table VI. The improvement in durability of the inventive alloy insert over the standard insert is as much as 63% in the turning test. The test conditions of these data were: 1000 SFPM, 0.075 depth of cut, 0.010 inches per revolution, and all tests were run on 4150 steel bars. The data are reported in time to failure in seconds. All examples found acceptable lasted a significantly longer period of time than the Standard. Those examples found unacceptable for the purposes of the present invention lasted a shorter or nearly equal amount of time as the standard.

The milling or interrupted cut test insert results display an even more dramatic improvement than observed in the turning tests, exhibiting an average of 300% greater durability than the Standard. The shock tests were run on grey cast iron with 0.075 depth of cut at 1200 SPFM; the inches per revolution started at 0.010 IPR and were increased, as stated above, every five cuts.

It is speculated that the addition of the toughening agent within the required range to zirconia to form the alloy improves the toughness of the cutting tool compositions by altering the anisotropic thermal expansion coefficients, the lattice parameters of both the tetragonal and monoclinic phases, and the chemical driving force—$\Delta G$ for the tetragonal to monoclinic phase transformation of the alloy. It is hypothesized that these changes result in a larger transformation zone, leading to improved toughness.

Although not rigorously proved, we postulate that the inclusion of the alloy in a ceramic matrix improves the toughness of cutting tool insert compositions in the same manner as above by altering the anisotropic thermal expansion coefficient and lattice parameters of both the tetragonal and monoclinic phases of the alloy, and the chemical driving force—$\Delta G$ for the tetragonal to monoclinic phase transformation, which, in turn, results in a larger transformation zone, thereby improving toughness. We have also observed what appears to be a self-healing property demonstrated by the inventive materials when used as cutting tool inserts. That is, whereas some chipping of the insert may initially occur, after that initial chipping, few further chips occur. We believe this phenomenon is a result of a compressive surface stress formed by the large transformation zone of the alloy.

We claim:

1. A ceramic cutting tool insert exhibiting a hardness greater than 15 GPa, a toughness greater than 6 MPa$\sqrt{m}$, and a thermal conductivity greater than 14 $Wm^{-1}°K.^{-1}$ consisting essentially, expressed in terms of percent by weight, of 20–45% zirconia alloy and 55–80% hard refractory ceramic matrix, said alloy consisting essentially, expressed in terms of mole percent on the oxide basis, of 1–4% of a toughening agent selected from the group consisting of $YNbO_4$, $YTaO_4$, $MNbO_4$, $MTaO_4$, and mixtures thereof, wherein M consists of a cation which replaces a Y cation on a mole basis selected from the group consisting of $Mg^{+2}$, $Ca^{+2}$, $Sc^{+3}$, and a rare earth metal ion selected from the group consisting of $La^{+3}$, $Ce^{+4}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, and mixtures thereof, and the remainder zirconia.

2. A ceramic cutting tool insert according to claim 1 wherein said hard refractory ceramic matrix is selected from the group consisting of alumina, $Al_2O_3$-$Cr_2O_3$ solid solution, sialon, silicon carbide, silicon nitride, titanium carbide, titanium diboride, zirconium carbide, and mixtures thereof.

3. A ceramic cutting tool insert according to claim 2 wherein $Cr_2O_3$ is present in an amount up to about 5 mole %.

4. A ceramic cutting tool insert according to claim 1 also including up to 35% by volume total of refractory ceramic fibers and/or whiskers.

5. A ceramic cutting tool insert according to claim 4 wherein said refractory ceramic fibers and/or whiskers are selected from the group consisting of alumina, mullite, sialon, silicon carbide, silicon nitride, AlN, BN, $B_4C$, zirconia, silicon oxycarbide, and spinel.

6. A method for producing a conductive ceramic cutting tool insert exhibiting a hardness greater than 15 GPa, a toughness greater than 6 MPa$\sqrt{m}$, and a thermal conductivity greater than 14 $Wm^{-1}°K.^{-1}$, comprising the steps of:

(a) forming a mixture of powders consisting essentially of, expressed in terms of percent by weight, 20–45% zirconia alloy and 55–80% hard refractory ceramic, said alloy consisting essentially, expressed in terms of mole percent on the oxide basis, of 1–4% of a toughening agent selected from the group consisting of $YNbO_4$, $YTaO_4$, $MNbO_4$, $MTaO_4$, and mixtures thereof, wherein M consists of a cation which replaces a Y cation on a mole basis selected from the group consisting of $Mg^{+2}$, $Ca^{+2}$, $Sc^{+3}$, and a rare earth metal ion selected from the group consisting of $La^{+3}$, $Ce^{+4}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, and mixtures thereof, and the remainder zirconia;

(b) shaping said mixture into a desired configuration for a cutting tool insert; and (c) sintering said shaped mixture at temperatures between about 1100° C.–1700° C. to form a hard, tough, thermally conductive body.

7. The method of claim 6 wherein said mixture contains no particles or agglomerates of particles greater than 50 microns in diameter.

8. The method of claim 6 wherein the hard refractory ceramic matrix is selected from the group consisting of alumina, $Al_2O_3$-$Cr_2O_3$ solid solution, sialon, silicon carbide, silicon nitride, titanium carbide, titanium diboride, zirconium carbide, and mixtures thereof.

9. The method of claim 6 wherein $Cr_2O_3$ is included in said mixture of powder in an amount up to about 5 mole %.

10. The method of claim 6 wherein up to 35% by volume refractory ceramic fibers and/or whiskers is included in said mixture of powders.

11. The method of claim 10 wherein said refractory ceramic fibers and/or whiskers are selected from the group consisting of alumina, sialon, mullite, silicon carbide, silicon nitride, AlN, BN, $B_4C$, zirconia, zircon, spinel, and silicon oxycarbide.

12. A method for producing a conductive ceramic cutting tool insert exhibiting a hardness greater than 15 GPa, a toughness greater than 6 $MPa\sqrt{m}$, and a thermal conductivity greater than 14 $Wm^{-1}°K.^{-1}$, comprising the steps of:

(a) forming a mixture of powders consisting essentially of a hard refractory ceramic, zirconia, a toughening agent selected from the group consisting of $YNbO_4$, $YTaO_4$, $MNbO_4$, $MTaO_4$, and mixtures thereof, wherein M consists of a cation which replaces a Y cation on a mole basis selected from the group consisting of $Mg^{+2}$, $Ca^{+2}$, $Sc^{+3}$, and a rare earth metal ion selected from the group consisting of $La^{+3}$, $Ce^{+4}$, $Ce^{+3}$, $Pr^{+3}$, $Nd^{+3}$, $Sm^{+3}$, $Eu^{+3}$, $Gd^{+3}$, $Tb^{+3}$, $Dy^{+3}$, $Ho^{+3}$, $Er^{+3}$, $Tm^{+3}$, $Yb^{+3}$, $Lu^{+3}$, and mixtures thereof or components which, when reacted together, will form said toughening agent, said powders being present in sufficient amounts and in the proper proportions to produce, upon sintering, a body consisting essentially, expressed in terms of percent by weight, of 20–45% zirconia alloy and 55–80% hard refractory ceramic, said alloy consisting essentially, expressed in terms of mole percent on the oxide basis, of 1–4% toughening agent and the remainder zirconia;

(b) shaping said mixture into a desired configuration for a cutting tool insert; and (c) sintering said shaped mixture at temperatures between about 1100° C.–1700° C. to form a hard, tough, thermally conductive body.

13. The method of claim 12 wherein said mixture contains no particles or agglomerates of particles greater than 50 microns in diameter.

14. The method of claim 12 wherein the hard refractory ceramic matrix is selected from the group consisting of alumina, $Al_2O_3$-$Cr_2O_3$ solid solution, sialon, silicon carbide, silicon nitride, titanium carbide, titanium diboride, zirconium carbide, and mixtures thereof.

15. The method of claim 12 wherein $Cr_2O_3$ is included in said mixture of powder in an amount up to about 5 mole %.

16. The method of claim 12 wherein up to 35% by volume refractory ceramic fibers and/or whiskers are entrained in said shaped mixture.

17. The method of claim 16 wherein said refractory ceramic fibers and/or whiskers are selected from the group consisting of alumina, sialon, mullite, silicon carbide, silicon nitride, AlN, BN, $B_4C$, zirconia, zircon, spinel, and silicon oxycarbide.

* * * * *